US006419714B2

(12) United States Patent
Thompson et al.

(10) Patent No.: US 6,419,714 B2
(45) **Date of Patent: *Jul. 16, 2002**

(54) EMULSIFIER FOR AN ACQUEOUS HYDROCARBON FUEL

(75) Inventors: Claire L. Thompson, Derby; Douglas M. Barr, Belper, both of (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/761,482

(22) Filed: Jan. 16, 2001

Related U.S. Application Data

(63) Continuation-in-part of application No. 09/755,577, filed on Jan. 5, 2001, now abandoned, which is a continuation-in-part of application No. 09/483,481, filed on Jan. 14, 2000, which is a continuation-in-part of application No. 09/390,925, filed on Sep. 7, 1999, now Pat. No. 6,368,367, which is a continuation-in-part of application No. 09/349,268, filed on Jul. 7, 1999, now Pat. No. 6,368,366.

(51) Int. Cl.[7] ..... C10L 1/32

(52) U.S. Cl. ..... 44/301; 44/302

(58) Field of Search ..... 44/301

(56) References Cited

U.S. PATENT DOCUMENTS

| | | | | |
|---|---|---|---|---|
| 2,619,330 A | | 11/1952 | Willems | |
| 2,858,200 A | | 10/1958 | Broughten | |
| 3,499,632 A | | 3/1970 | Piros | |
| 3,639,242 A | | 2/1972 | LeSuer | 252/56 R |
| 3,708,522 A | | 1/1973 | LeSuer | 260/485 |
| 3,756,794 A | * | 9/1973 | Ford | 44/301 |
| 3,818,876 A | | 6/1974 | Voogd | |
| 3,855,103 A | | 12/1974 | McLaren et al. | |
| 3,876,391 A | | 4/1975 | McCoy et al. | |
| 4,048,080 A | | 9/1977 | Lee et al. | |
| 4,084,940 A | | 4/1978 | Lissant | |
| 4,146,499 A | | 3/1979 | Rosano | |
| 4,207,078 A | | 6/1980 | Sweeney et al. | |
| 4,329,249 A | | 5/1982 | Forsberg | |
| 4,388,893 A | | 6/1983 | Apfel | |
| 4,394,131 A | | 7/1983 | Marro, Jr. et al. | 44/51 |
| 4,433,917 A | | 2/1984 | Mendel et al. | |
| 4,438,731 A | | 3/1984 | Maggio | |
| 4,447,348 A | * | 5/1984 | Forsberg | 44/301 |
| 4,452,712 A | | 6/1984 | Laemmle | |
| 4,482,356 A | | 11/1984 | Hanlon | |
| 4,517,104 A | | 5/1985 | Bloch et al. | 252/51.5 |
| 4,561,861 A | | 12/1985 | Davis et al. | |
| 4,585,461 A | | 4/1986 | Gorman | |
| 4,613,341 A | | 9/1986 | Zaweski et al. | |
| 4,621,927 A | | 11/1986 | Hiroi | |
| 4,686,054 A | | 8/1987 | Wisotsky et al. | 252/32.7 |
| 4,696,638 A | | 9/1987 | DenHerder | 431/4 |
| 4,697,929 A | | 10/1987 | Muller | |
| 4,708,753 A | | 11/1987 | Forsberg | |
| 4,770,670 A | * | 9/1988 | Hazbun et al. | 44/301 |
| 4,776,977 A | | 10/1988 | Taylor | |
| 4,892,562 A | | 1/1990 | Bowers et al. | |
| 4,908,154 A | | 3/1990 | Cook et al. | |
| 4,916,631 A | | 4/1990 | Crain et al. | |
| 4,938,606 A | | 7/1990 | Kunz | |
| 4,953,097 A | | 8/1990 | Crain et al. | |
| 4,983,319 A | | 1/1991 | Gregoli et al. | |
| 4,986,858 A | | 1/1991 | Oliver et al. | |
| 5,000,757 A | | 3/1991 | Puttock et al. | |
| 5,104,621 A | | 4/1992 | Pfost et al. | |
| 5,271,370 A | | 12/1993 | Shimada et al. | 123/568 |
| 5,279,626 A | | 1/1994 | Cunningham et al. | |
| 5,352,377 A | | 10/1994 | Blain et al. | |
| 5,389,111 A | | 2/1995 | Nikanjam et al. | |
| 5,389,112 A | | 2/1995 | Nikanjam et al. | |
| 5,399,293 A | | 3/1995 | Nunez et al. | |
| 5,404,841 A | | 4/1995 | Valentine | |
| 5,411,558 A | | 5/1995 | Taniguchi et al. | |
| 5,445,656 A | | 8/1995 | Marelli | |
| 5,454,964 A | | 10/1995 | Blackborow et al. | |
| 5,478,365 A | | 12/1995 | Nikanjam et al. | |
| 5,501,714 A | | 3/1996 | Valentine et al. | |
| 5,503,772 A | | 4/1996 | Rivas et al. | |
| 5,505,876 A | * | 4/1996 | Rivas et al. | 44/301 |
| 5,544,856 A | | 8/1996 | King et al. | |
| 5,556,574 A | | 9/1996 | Rivas et al. | |
| 5,563,189 A | | 10/1996 | Hosokawa et al. | |
| 5,584,326 A | | 12/1996 | Galli | |
| 5,622,920 A | | 4/1997 | Rivas et al. | |
| 5,624,999 A | | 4/1997 | Lombardi et al. | |
| 5,632,596 A | | 5/1997 | Ross | |
| 5,643,528 A | | 7/1997 | Le Gras | |

(List continued on next page.)

FOREIGN PATENT DOCUMENTS

| | | | |
|---|---|---|---|
| AU | 711 348 | 3/1997 | 1/32 |
| WO | WO97/34969 | 3/1997 | 1/32 |
| WO | WO 99/13028 | 3/1999 | |
| WO | WO99/13028 | 3/1999 | |
| WO | WO 99/13030 | 3/1999 | |
| WO | WO 99/13031 | 3/1999 | |

OTHER PUBLICATIONS

Kady International; Continuous Flow Dispersion Mills; 2/98; 5 pages (brochure).

Ika, Inc.; Batch Mixers, A Closer Look (www.silverson-.com/btchmxr2.htm): Mar. 18, 1999 (Printed from internet); 4 pages.

Sonic Corp.; Tri–Homo Colloid Mills, catalog TH980; 4 pages.

Beacher; Emulsions Theory & Practice, 2$^{nd}$ Edition, pp. 267–325; 1965.

Coughanowr et al.; Process Systems Analysis & Control; McGraw–Hill Book Co., pp. ix–x; 1965.

Sonic Corp; Ultrasonic Mixing (brochure) 6 pages.

Ika; Maschinenbau Dispersing (brochure); 40 pages.

*Primary Examiner*—Ellen M. McAvoy
(74) *Attorney, Agent, or Firm*—Teresan W. Gilbert; Michael F. Esposito

(57) ABSTRACT

A novel crosslinked emulsifier is employed to produce a stable aqueous hydrocarbon fuel emulsion.

20 Claims, No Drawings

U.S. PATENT DOCUMENTS 5,669,938 A 9/1997 Schwab
5,670,462 A 9/1997 Barr et al. ..... 508/291
5,682,842 A 11/1997 Coleman et al.
5,706,896 A 1/1998 Tubel et al.
5,719,108 A 2/1998 Wilby et al. ..... 508/232
5,725,609 A * 3/1998 Rivas et al. ..... 44/301
5,743,922 A * 4/1998 Peter-Hoblyn et al. ..... 44/301
5,746,783 A 5/1998 Compere et al.
5,792,223 A 8/1998 Rivas et al.
5,820,640 A * 10/1998 Ikura et al. ..... 44/301
5,851,245 A 12/1998 Moriyama et al.
5,862,315 A 1/1999 Glaser et al.
5,863,301 A 1/1999 Grosso et al.
5,868,201 A 2/1999 Bussear et al.
5,873,916 A 2/1999 Cemenska et al.
5,879,079 A 3/1999 Hohmann et al.
5,879,419 A 3/1999 Moriyama et al.
5,895,565 A 4/1999 Steininger et al.
5,896,292 A 4/1999 Hosaka et al.
5,976,200 A 11/1999 Rivas et al. ..... 44/301
5,993,495 A 11/1999 Sanchez et al. ..... 44/301
6,068,670 A * 5/2000 Haupais et al. ..... 44/301

* cited by examiner

EMULSIFIER FOR AN ACQUEOUS HYDROCARBON FUEL

This is a continuation in part of U.S. application Ser. No. 09/755,577, filed Jan. 5, 2001, now abandoned; which is a continuation in part of U.S. application Ser. No. 09/483,481 filed Jan. 14, 2000, now allowed; which is a continuation in part of U.S. application Ser. No. 09/390,925 filed Sep. 7, 1999, now U.S. Pat. No. 6,368,367; which is a continuation in part of U.S. application Ser. No. 09/349,268 filed Jul. 7, 1999, now U.S. Pat. No. 6,368,366. All of the disclosures in the prior applications are incorporated herein by reference in their entirety.

TECHNICAL FIELD

The invention relates to an emulsifier that is the reaction product of a polyacidic polymer with a fuel soluble dispersant. More particularly, the invention relates to novel emulsifiers that are used for making an aqueous hydrocarbon fuel suitable for combustion in engines.

BACKGROUND OF THE INVENTION

Internal combustion engines, especially diesel engines, using water mixed with fuel in the combustion chamber can produce lower NOx, hydrocarbon and particulate emissions per unit of power output. Nitrogen oxides are an environmental issue because they contribute to smog and pollution. Governmental regulation and environmental concerns have driven the need to reduce NOx emissions from engines.

Diesel fueled engines produce NOx due to the relatively high flame temperatures reached during combustion. The reduction of NOx production includes the use of catalytic converters, using "clean" fuels, recirculation of exhaust and engine timing changes. These methods are typically expensive or complicated to be commercially used.

Water is inert toward combustion, but lowers the peak combustion temperature resulting in reduced particulates and NOx formation. When water is added to the fuel it forms an emulsion and these emulsions are generally unstable. Stable water-in-fuel emulsions of small particle size are difficult to reach and maintain. It would be advantageous to make a stable water-in-fuel emulsion that can be made continuously and is stable in storage.

It has been found advantageous to produce stable water-in-fuel emulsions by employing a novel emulsifier that is polyacidic polymer crosslinked with a fuel-soluble dispersant. It would be advantageous to make an emulsifier with improved hydrolytic stability so as to improve the long-term stability of the water in fuel emulsifier.

The term "NOx" is used herein to refer to any of the nitrogen oxides, NO, $NO_2$, $N_2O$, or mixtures of two or more thereof. The terms "aqueous hydrocarbon fuel emulsion" and "water fuel emulsion" are interchangeable. The terms "aqueous hydrocarbon fuel" and "water fuel blend" are interchangeable.

SUMMARY OF THE INVENTION

The invention relates to an emulsifier for an aqueous hydrocarbon fuel emulsion comprised of water, fuel such as diesel, gasoline or the like and an emulsifier. The emulsifier includes but is not limited to: (i) at least one fuel-soluble product made by reacting at least one hydrocarbyl-substituted carboxylic acid acylating agent with ammonia or an amine, the hydrocarbyl substituent of said acylating agent having about 50 to about 500 carbon atoms; (ii) at least one of an ionic or a nonionic compound having a hydrophilic-lipophilic balance (HLB) of about 1 to about 40; (iii) a mixture of (i), (ii); (iv) a water-soluble compound selected from the group consisting of amine salts, ammonium salts, azide compounds, nitrate esters, nitramine, nitro compounds, alkali metal salts, alkaline earth metal salts, in combination with (i), (ii), (iii), (v) or (vi); the reaction product of polyacidic polymer with at least one fuel soluble product made by reacting at least one hydrocarbyl-substituted carboxylic acid acylating agent with a hydroxy amine and/or a polyamine; and (vi), a mixture of (ii) and (v).

More particularly, the invention relates to a process for making an aqueous hydrocarbon fuel composition comprising:

a) preparing at least one emulsifier to form a hydrocarbon fuel emulsifier mixture wherein the emulsifier comprises the reaction product of (A) a polyacidic polymer, (B) at least one fuel soluble product made by reacting at least one hydrocarbyl-substituted carboxylic acid acylating agent and (C) a hydroxy amine and/or a polyamine;

b) mixing a liquid hydrocarbon fuel with at least one emulsifier to form a hydrocarbon fuel emulsifier mixture, and c) mixing the hydrocarbon fuel emulsifier mixture with water or water and ammonium nitrate under emulsification conditions to form an aqueous hydrocarbon fuel composition, wherein the aqueous hydrocarbon fuel composition includes a discontinuous phase, the discontinuous aqueous phase being comprised of aqueous droplets having a mean diameter of 1.0 micron or less.

More particularly, the invention relates to an aqueous hydrocarbon fuel composition comprising:

a) a continuous phase of hydrocarbon fuel, b) a discontinuous aqueous phase being comprised of aqueous droplets having a mean diameter of 1.0 micron or less;

c) an emulsifying amount of an emulsifier composition comprising the reaction product of (A) a polyacidic polymer, (B) at least one fuel soluble product made by reacting at least one hydrocarbyl-substituted carboxylic acid acylating agent, and (C), a hydroxy amine and/or a polyamine.

The water hydrocarbon fuel emulsion optionally includes additives. The additives include but are not limited to a cetane improver(s), an organic solvent(s), an antifreeze agent(s), surfactant(s), other additives known for their use in fuels and combinations thereof.

The Water Fuel Emulsions

The water fuel emulsions are comprised of: a continuous fuel phase; a discontinuous water or aqueous phase; and an emulsifying amount of an emulsifier. The emulsions may contain other additives that include but are not limited to cetane improvers, organic solvents, antifreeze agents, and the like. The water or aqueous phase of the aqueous hydrocarbon fuel emulsion is comprised of droplets having a mean diameter of 1.0 micron or less. Thus, the emulsification generally occurs by shear mixing and is conducted under sufficient conditions to provide such a droplet size.

These emulsions may be prepared by the steps of (1) mixing the fuel, emulsifier and other desired additives using standard mixing techniques to form a fuel-chemical additives mixture (hydrocarbon fuel/additives mixture); and (2) mixing the fuel-chemical additives mixture with water (and optionally an antifreeze agent) under emulsification conditions to form the desired aqueous hydrocarbon fuel emulsion. Alternatively, the water-soluble compounds used in the emulsifier can be mixed with the water prior to the high-shear mixing.

The invention provides for a batch, semi-batch or continuous process for making an aqueous hydrocarbon fuel by forming a stable emulsion in which the water is suspended in a continuous phase of fuel and wherein the water droplets have a mean diameter of 1.0 microns or less.

The hydrocarbon fuel/additive mixture contains about 50% to about 99% by weight, in another embodiment about 85% to about 98% by weight, and in another embodiment about 95% to about 98% by weight hydrocarbon fuel, and it further contains about 0.05% to about 25%, in another embodiment about 1% to about 15%, and in another embodiment about 2% to about 5% by weight of the emulsifier.

Optionally, additives may be added to the emulsifier, the fuel, the water or combinations thereof. The additives include but are not limited to cetane improvers, organic solvents, antifreeze agents, surfactants, other additives known for their use in fuel and the like. The additives are added to the emulsifier, hydrocarbon fuel or the water prior to and, in the alternative, at the first emulsification device dependent upon the solubility of the additive. However, it is preferable to add the additives to the emulsifier to form an additive emulsifier mixture. The additives are generally in the range of about 1% to about 40% by weight, in another embodiment about 5% to about 30% by weight, and in another embodiment about 7% to about 25% by weight of the additive emulsifier mixture.

The water, which can optionally include but is not limited to antifreeze, ammonium nitrate or mixtures thereof. Ammonium nitrate is generally added to the water mixture as aqueous solution. In one embodiment the water, the alcohol and/or the ammonium nitrate are mixed dynamically and fed continuously to the fuel additives stream. In another embodiment the water, antifreeze, ammonium nitrate or mixtures thereof flow out of separate tanks and/or combinations thereof into or mixed prior to the emulsification device. In one embodiment the water, water alcohol, water-ammonium-nitrate, or water-alcohol ammonium nitrate mixture meets the hydrocarbon fuel additives mixture immediately prior to or in the emulsification device.

The mixture is emulsified to form a stable emulsion with the desired water droplet size. The aqueous hydrocarbon fuel emulsion includes a discontinuous aqueous phase in a continuous fuel phase. The discontinuous aqueous phase comprises aqueous droplets having a mean diameter of 1.0 micron or less by the time the aqueous hydrocarbon fuel emulsion has been processed by emulsification.

High-shear devices that may be used include but are not limited to IKA Work Dispax, the IK shear mixers include the DR3-6 with three stages of rotor/stator combinations. The tip speed of the rotor/stator generators may be varied by a variable frequency chive that controls the motor. The Silverson mixer is a two-stage mixer, which incorporates a rotor/stator design. The mixer has high-volume pumping characteristics similar to centrifugal pump. Inline shear mixers by Silverson Corporation (a rotor-stator emulsification approach); Jet Mixers (venturi-style/cavitation shear mixers), Ultrasonolator made by the Sonic Corp. (ultrasonic emulsification approach), Microfluidizer shear mixers available by Microfluidics Inc. (high-pressure homogenization shear mixers), ultrasonic mixers, and any other available high-shear mixer.

The process is generally done under ambient conditions at atmospheric pressure. The process generally occurs at ambient temperature. In one embodiment the temperature is in the range of about ambient temperature to about 212° F., and in another embodiment in the range of about 40° F. to about 150° F.

A programmable logic controller (plc), may be provided for governing the flow of the aqueous hydrocarbon fuel additive mixture, the water, and aqueous hydrocarbon fuel emulsion thereby controlling the flow rates and mixing ratio in accordance with the prescribed blending rates. The plc stores component percentages input by the operator. The plc then uses these percentages to define volumes/flow of each component required. Continuous flow sequence is programmed into the plc. The plc electronically monitors all level switches, valve positions and fluid meters.

The Liquid Hydrocarbon Fuel

The liquid hydrocarbon fuel comprises hydrocarbonaceous petroleum distillate fuel, water, oils, liquid fuels derived from vegetable sources, liquid fuels derived from mineral sources, and mixtures thereof. The liquid hydrocarbon fuel may be any and all hydrocarbonaceous petroleum distillate fuels including but not limited to motor gasoline as defined by ASTM Specification D439 or diesel fuel or fuel oil as defined by ASTM Specification D396 or the like (kerosene, naptha, aliphatics and paraffinics). The liquid hydrocarbon fuels can contain elements other than carbon and hydrogen including but not limited to alcohols such as methanol, ethanol and the like, ethers such as diethyl ether, methyl ethyl ether and the like, organo-nitro compounds and the like; liquid fuels derived from vegetable sources or mineral sources such as corn, alfalfa, shale, coal and the like. The liquid hydrocarbon fuels also include mixtures of one or more hydrocarbonaceous fuels and one or more non-hydrocarbonaceous materials. Examples of such mixtures are combinations of gasoline and ethanol and of diesel fuel and ether. In one embodiment, the liquid hydrocarbon fuel is any gasoline. Generally, gasoline is a mixture of hydrocarbons having an ASTM distillation range from about 60° C. at the 10% distillation point to about 205° C. at the 90% distillation point. In one embodiment, the gasoline is a chlorine-free or low-chlorine gasoline characterized by a chlorine content of no more than about 10 ppm.

In one embodiment, the liquid hydrocarbon fuel is any diesel fuel. Diesel fuels typically have a 90% point distillation temperature in the range of about 300° C. to about 390° C., and in one embodiment about 330° C. to about 350° C. The viscosity for these fuels typically ranges from about 1.3 to about 24 centistokes at 40° C. The diesel fuels can be classified as any of Grade Nos. 1-D, 2-D or 4-D as specified in ASTM D975. The diesel fuels may contain alcohols and esters. In one embodiment the diesel fuel has a sulfur content of up to about 0.05% by weight (low-sulfur diesel fuel) as determined by the test method specified in ASTM D2622-87. In one embodiment, the diesel fuel is a chlorine-free or low-chlorine diesel fuel characterized by chlorine content of no more than about 10 ppm.

The liquid hydrocarbon fuel is present in the aqueous hydrocarbon fuel emulsion at a concentration of about 50% to about 95% by weight, and in one embodiment about 60% to about 95% by weight, and in one embodiment about 65% to about 85% by weight, and in one embodiment about 80% to about 90% by weight.

The Water

The water used in forming the aqueous hydrocarbon fuel emulsions may be taken from any source. The water includes but is not limited to tap, deionized, demineralized, purified, for example, using reverse osmosis or distillation, and the like.

The water may be present in the aqueous hydrocarbon fuel emulsions at a concentration of about 1% to about 50% by weight, and in one embodiment about 5% to about 50% by weight, and in one embodiment about 5% to about 40% being weight, and in one embodiment about 5% to about 25% by weight, and in one embodiment about 10% to about 20% water.

The Emulsifier

The emulsifier is comprised of: (i) at least one fuel-soluble product made by reacting at least one hydrocarbyl-substituted carboxylic acid acylating agent with ammonia or an amine, the hydrocarbyl substituent of said acylating agent having about 50 to about 500 carbon atoms; (ii) at least one of an ionic or a nonionic compound having a hydrophilic-lipophilic balance (HLB) in one embodiment of about 1 to about 40; in one embodiment about 1 to about 30, in one embodiment about 1 to about 20, and in one embodiment about 1 to about 15; (iii) a mixture of (i) and (ii); (iv) a water-soluble compound selected from the group consisting of amine salts, ammonium salts, azide compounds, nitro compounds, alkali metal salts, alkaline earth metal salts, and mixtures thereof in combination of with (i), (ii), (iii), (v) or (vi), the reaction product of a polyacidic polymer with at least one fuel soluble product which fuel-soluble product is made by reacting at least one hydrocarbyl-substituted carboxylic acid acylating agent with a hydroxy amine and/or polyamine; and (vi), a mixture of (ii) and (v).

The emulsifier may be present in the water fuel emulsion at a concentration of about 0.05% to about 20% by weight, and in one embodiment about 0.05% to about 10% by weight, and in one embodiment about 0.1% to about 5% by weight, and in one embodiment about 0.1% to about 3% by weight.

The Fuel-Soluble Product (i)

The fuel-soluble product (i) may be at least one fuel-soluble product made by reacting at least one hydrocarbyl-substituted carboxylic acid acylating agent with ammonia or an amine, the hydrocarbyl substituent of said acylating agent having about 50 to about 500 carbon atoms.

The hydrocarbyl-substituted carboxylic acid acylating agents may be carboxylic acids or reactive equivalents of such acids. The reactive equivalents may be an acid halides, anhydrides, or esters, including partial esters and the like. The hydrocarbyl substituents for these carboxylic acid acylating agents may contain from about 50 to about 500 carbon atoms, and in one embodiment about 50 to about 300 carbon atoms, and in one embodiment about 60 to about 200 carbon atoms. In one embodiment, the hydrocarbyl substituents of these acylating agents have number average molecular weights of about 700 to about 3000, and in one embodiment about 900 to about 2300.

The hydrocarbyl-substituted carboxylic acid acylating agents may be made by reacting one or more alpha-beta olefinically unsaturated carboxylic acid reagents containing 2 to about 20 carbon atoms, exclusive of the carboxyl groups, with one or more olefin polymers as described more fully hereinafter.

The alpha-beta olefinically unsaturated carboxylic acid reagents may be either monobasic or polybasic in nature. Exemplary of the monobasic alpha-beta olefinically unsaturated carboxylic acid include the carboxylic acids corresponding to the formula

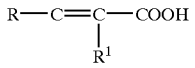

wherein R is hydrogen, or a saturated aliphatic or alicyclic, aryl, alkylaryl or heterocyclic group, preferably hydrogen or a lower alkyl group, and $R^1$ is hydrogen or a lower alkyl group. The total number of carbon atoms in R and $R^1$ typically does not exceed about 18 carbon atoms. Specific examples of useful monobasic alpha-beta olefinically unsaturated carboxylic acids include acrylic acid; methacrylic acid; cinnamic acid; crotonic acid; 3-phenyl propenoic acid; alpha, and beta-decenoic acid. The polybasic acid reagents are preferably dicarboxylic, although tri- and tetracarboxylic acids can be used. Exemplary polybasic acids include maleic acid, fumaric acid, mesaconic acid, itaconic acid and citraconic acid. Reactive equivalents of the alpha-beta olefinically unsaturated carboxylic acid reagents include the anhydride, ester or amide functional derivatives of the foregoing acids. A useful reactive equivalent is maleic anhydride.

The olefin monomers from which the olefin polymers may be derived are polymerizable olefin monomers characterized by having one or more ethylenic unsaturated groups. They may be monoolefinic monomers such as ethylene, propylene, 1-butene, isobutene and 1-octene or polyolefinic monomers (usually di-olefinic monomers such as 1,3-butadiene and isoprene). Usually these monomers are terminal olefins, that is, olefins characterized by the presence of the group>$C{=}CH_2$. However, certain internal olefins can also serve as monomers (these are sometimes referred to as medial olefins). When such medial olefin monomers are used, they normally are employed in combination with terminal olefins to produce olefin polymers that are interpolymers. Although, the olefin polymers may also include aromatic groups (especially phenyl groups and lower alkyl and/or lower alkoxy-substituted phenyl groups such as para (tertiary-butyl)-phenyl groups) and alicyclic groups such as would be obtained from polymerizable cyclic olefins or alicyclic-substituted polymerizable cyclic olefins, the olefin polymers are usually free from such groups. Nevertheless, olefin polymers derived from such interpolymers of both 1,3-dienes and styrenes such as 1,3-butadiene and styrene or para-(tertiary butyl) styrene are exceptions to this general rule. In one embodiment, the olefin polymer is a partially hydrogenated polymer derived from one or more dienes. Generally the olefin polymers are homo- or interpolymers of terminal hydrocarbyl olefins of about 2 to about 30 carbon atoms, and in one embodiment about 2 to about 16 carbon atoms. A more typical class of olefin polymers is selected from that group consisting of homo- and interpolymers of terminal olefins of 2 to about 6 carbon atoms, and in one embodiment 2 to about 4 carbon atoms.

Specific examples of terminal and medial olefin monomers which can be used to prepare the olefin polymers include ethylene, propylene, 1-butene, 2-butene, isobutene, 1-pentene, 1-hexene, 1-heptene, 1-octene, 1-nonene, 1-decene, 2-pentene, propylene tetramer, diisobutylene, isobutylene trimer, 1,2-butadiene, 1,3-butadiene, 1,2-pentadiene, 1,3-pentadiene, isoprene, 1,5-hexadiene, 2-chloro 1,3-butadiene, 2-methyl-1-heptene, 3-cyclohexyl-1-butene, 3,3-dimethyl 1-pentene, styrene, divinylbenzene, vinyl-acetate, allyl alcohol, 1-methylvinylacetate, acrylonitrile, ethyl acrylate, ethylvinylether and methyl-vinylketone. Of these, the purely hydrocarbon monomers are more typical and the terminal olefin monomers are especially useful.

In one embodiment, the olefin polymers are polyisobutenes such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutenes generally contain predominantly (that is, greater than about 50% of the total repeat units) isobutene repeat units of the configuration

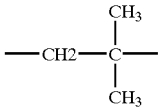

In one embodiment, the olefin polymer is a polyisobutene group (or polyisobutylene group) having a number average molecular weight of about 700 to about 3000, and in one embodiment about 900 to about 2300.

In one embodiment, the hydrocarbyl-substituted carboxylic acid acylating agent is a hydrocarbyl-substituted succinic acid or anhydride represented correspondingly by the formulae

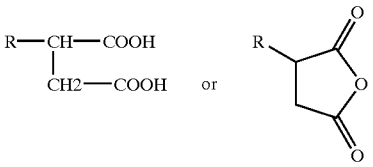

wherein R is hydrocarbyl group of about 50 to about 500 carbon atoms, and in one embodiment from about 50 to about 300, and in one embodiment from about 60 to about 200 carbon atoms. The production of these hydrocarbyl-substituted succinic acids or anhydrides via alkylation of maleic acid or anhydride or its derivatives with a halohydrocarbon or via reaction of maleic acid or anhydride with an olefin polymer having a terminal double bond is well known to those of skill in the art and need not be discussed in detail herein.

The hydrocarbyl-substituted carboxylic acid acylating agent may be a hydrocarbyl-substituted succinic acylating agent consisting of hydrocarbyl substituent groups and succinic groups. The hydrocarbyl substituent groups are derived from olefin polymers as discussed above. In one embodiment, the hydrocarbyl-substituted carboxylic acid acylating agent is characterized by the presence within its structure of an average of at least 1.3 succinic groups, and in one embodiment from about 1.3 to about 2.5, and in one embodiment about 1.5 to about 2.5, and in one embodiment from about 1.7 to about 2.1 succinic groups for each equivalent weight of the hydrocarbyl substituent. In one embodiment, the hydrocarbyl-substituted carboxylic acid acylating agent is characterized by the presence within its structure of about 1.0 to about 1.3, and in one embodiment about 1.0 to about 1.2, and in one embodiment from about 1.0 to about 1.1 succinic groups for each equivalent weight of the hydrocarbyl substituent.

In one embodiment, the hydrocarbyl-substituted carboxylic acid acylating agent is a polyisobutene-substituted succinic anhydride, the polyisobutene substituent having a number average molecular weight of about 1,500 to about 3,000, and in one embodiment about 1,800 to about 2,300, said first polyisobutene-substituted succinic anhydride being characterized by about 1.3 to about 2.5, and in one embodiment about 1.7 to about 2.1 succinic groups per equivalent weight of the polyisobutene substituent.

In one embodiment, the hydrocarbyl-substituted carboxylic acid acylating agent is a polyisobutene-substituted succinic anhydride, the polyisobutene substituent having a number average molecular weight of about 700 to about 1300, and in one embodiment about 800 to about 1,000, said polyisobutene-substituted succinic anhydride being characterized by about 1.0 to about 1.3, and in one embodiment about 1.0 to about 1.2 succinic groups per equivalent weight of the polyisobutene substituent.

For purposes of this invention, the equivalent weight of the hydrocarbyl substituent group of the hydrocarbyl-substituted succinic acylating agent is deemed to be the number obtained by dividing the number average molecular weight ($M_n$) of the polyolefin from which the hydrocarbyl substituent is derived into the total weight of all the hydrocarbyl substituent groups present in the hydrocarbyl-substituted succinic acylating agents. Thus, if a hydrocarbyl-substituted acylating agent is characterized by a total weight of all hydrocarbyl substituents of 40,000 and the $M_n$ value for the polyolefin from which the hydrocarbyl substituent groups are derived is 2000, then that substituted succinic acylating agent is characterized by a total of 20 (40,000/2000=20) equivalent weights of substituent groups.

The ratio of succinic groups to equivalent of substituent groups present in the hydrocarbyl-substituted succinic acylating agent (also called the "succination ratio") can be determined by one skilled in the art using conventional techniques (such as from saponification or acid numbers). For example, the formula below can be used to calculate the succination ratio where maleic anhydride is used in the acylation process, where crossover line is:

$$SR = \frac{M_n \times (\text{Sap. No. of acylating agent})}{(56100 \times 2) - (98 \times \text{Sap. No. of Acylating agent}}$$

In this equation, SR is the succination ratio, $M_n$ is the number average molecular weight, and Sap. No. is the saponification number. In the above equation, Sap. No. of acylating agent=measured Sap. No. of the final reaction mixture/AI wherein AI is the active ingredient content expressed as a number between 0 and 1, but not equal to zero. Thus an active ingredient content of 80% corresponds to an AI value of 0.8. The AI value can be calculated by using techniques such as column chromatography, which can be used to determine the amount of unreacted polyalkene in the final reaction mixture. As a rough approximation, the value of AI is determined after subtracting the percentage of unreacted polyalkene from 100 and divide by 100.

The fuel-soluble product (i) may be formed using ammonia, an amine and/or metals such as Na, K, Ca, and the like. The amines useful for reacting with the acylating agent to form the product (i) include monoamines, polyamines, and mixtures thereof.

The monoamines have only one amine functionality whereas the polyamines have two or more. The amines may be primary, secondary or tertiary amines. The primary amines are characterized by the presence of at least one —$NH_2$ group; the secondary by the presence of at least one H—N<group. The tertiary amines are analogous to the primary and secondary amines with the exception that the hydrogen atoms in the —$NH_2$ or H—N<groups are replaced by hydrocarbyl groups. Examples of primary and secondary monoamines include ethylamine, diethylamine, n-butylamine, di-n-butylamine, allylamine, isobutylamine, cocoamine, stearylamine, laurylamine, methyllaurylamine, oleylamine, N-methyloctylamine, dodecylamine, and octadecylamine. Suitable examples of tertiary monoamines include trimethylamine, triethylamine, tripropylamine, tributylamine, monomethyldimethylamine, monoethyldimethylamine, dimethylpropylamine, dimethylbutylamine, dimethylpentylamine, dimethylhexylamine, dimethylheptylamine, and dimethyloctylamine.

The amine may be a hydroxyamine. The hydroxyamine may be a primary, secondary or tertiary amine. Typically, the hydroxamines are primary, secondary or tertiary alkanol amines.

The alkanol amines may be represented by the formulae:

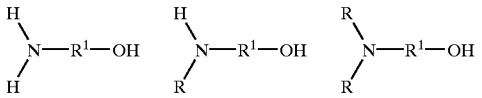

wherein in the above formulae each R is independently a hydrocarbyl group of 1 to about 8 carbon atoms, or a hydroxy-substituted hydrocarbyl group of 2 to about 8 carbon atoms and each R' independently is a hydrocarbylene (i.e., a divalent hydrocarbon) group of 2 to about 18 carbon atoms. The group —R'—OH in such formulae represents the hydroxy-substituted hydrocarbylene group. R' may be an acyclic, alicyclic, or aromatic group. In one embodiment, R' is an acyclic straight or branched alkylene group such as ethylene, 1,2-propylene, 1,2-butylene, 1,2-octadecylene, etc. group. When two R groups are present in the same molecule they may be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxy lower alkyl)-morpholines, -thiomorpholines, -piperidines, -oxazolidines, -thiazolidines and the like. Typically, however, each R is independently a lower alkyl group of up to seven carbon atoms.

Suitable examples of the above hydroxyamines include mono-, di-, and triethanolamine, dimethylethanol amine, diethylethanol amine, di-(3-hydroxy propyl) amine, N-(3-hydroxybutyl) amine, N-(4-hydroxy butyl) amine, and N,N-di-(2-hydroxypropyl) amine.

The amine may be an alkylene polyamine. Especially useful are the alkylene polyamines represented by the formula

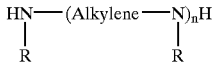

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. Specific examples of such polyamines include ethylene diamine, diethylene triamine, triethylene tetramine, propylene diamine, trimethylene diamine, tripropylene tetramine, tetraethylene pentamine, hexaethylene heptamine, pentaethylene hexamine, or a mixture of two or more thereof.

Ethylene polyamines are useful. These are described in detail under the heading Ethylene Amines in Kirk Othmer's "Encyclopedia of Chemical Technology", 2d Edition, Vol. 7, pages 22–37, Interscience Publishers, New York (1965). These polyamines may be prepared by the reaction of ethylene dichloride with ammonia or with ethylene diamine, or by reaction of an ethylene imine with a ring opening reagent such as water, ammonia, or the like. These reactions result in the production of a complex mixture of polyalkylene polyamines including cyclic condensation products such as piperazines.

In one embodiment, the amine is a polyamine bottoms or a heavy polyamine. The term "polyamine bottoms" refers to those polyamines resulting from the stripping of a polyamine mixture to remove lower molecular weight polyamines and volatile components to leave, as residue, the polyamine bottoms. In one embodiment, the polyamine bottoms are characterized as having less than about 2% by weight total diethylene triamine or triethylene tetramine. A useful polyamine bottoms is available from Dow Chemical under the trade designation E-100. This material is described as having a specific gravity at 15.6° C. of 1.0168, a nitrogen content of 33.15% by weight, and a viscosity at 40° C. of 121 centistokes. Another polyamine bottoms that may be used is commercially available from Union Carbide under the trade designation HPA-X. This polyamine bottoms product contains cyclic condensation products such as piperazine and higher analogs of diethylene triamine, triethylene tetramine, and the like.

The term "heavy polyamine" refers to polyamines that contain seven or more nitrogen atoms per molecule, or polyamine oligomers containing seven or more nitrogens per molecule, and two or more primary amines per molecule. These are described in European Patent No. EP 0770098, which is incorporated herein by reference for its disclosure of such heavy polyamines.

The fuel-soluble product (i) may be a salt, an ester, an ester/salt, an amide, an imide, or a combination of two or more thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. In one embodiment, the amine is a hydroxyamine, the hydrocarbyl-substituted carboxylic acid acylating agent is a hydrocarbyl-substituted succinic anhydride, and the resulting fuel-soluble product is a half ester and half salt, i.e., an ester/salt. In one embodiment, the amine is an alkylene polyamine, the hydrocarbyl-substituted carboxylic acid acylating agent is a hydrocarbyl-substituted succinic anhydride, and the resulting fuel-soluble product is a succinimide.

The reaction between the hydrocarbyl-substituted carboxylic acid acylating agent and the ammonia or amine is carried out under conditions that provide for the formation of the desired product. Typically, the hydrocarbyl-substituted carboxylic acid acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the hydrocarbyl-substituted carboxylic acid acylating agent and the ammonia or amine are reacted in amounts sufficient to provide from about 0.3 to about 3 equivalents of hydrocarbyl-substituted carboxylic acid acylating agent per equivalent of ammonia or amine. In one embodiment, this ratio is from about 0.5:1 to about 2:1, and in one embodiment about 1:1.

In one embodiment, the fuel soluble product (i) comprises: (i)(a) a first fuel-soluble product made by reacting a first hydrocarbyl-substituted carboxylic acid acylating agent with ammonia or an amine such as polyamine, the hydrocarbyl substituent of said first acylating agent having about 50 to about 500 carbon atoms; and (i)(b) a second fuel-soluble product made by reacting a second hydrocarbyl-substituted carboxylic acid acylating agent with ammonia or an amine such as polyamine, the hydrocarbyl substituent of said second acylating agent having about 50 to about 500 carbon atoms. In this embodiment, the products (i)(a) and (i)(b) are different. For example, the molecular weight of the hydrocarbyl substituent for the first acylating agent may be different than the molecular weight of the hydrocarbyl substituent for the second acylating agent. In one embodiment, the number average molecular weight for the hydrocarbyl substituent for the first acylating agent may be in the range of about 1500 to about 3000, and in one embodiment about 1800 to about 2300, and the number average molecular weight for the hydrocarbyl substituent for the second acylating agent may be in the range of about 700 to about 1300, and in one embodiment about 800 to about 1000. The first hydrocarbyl-substituted carboxylic acid acylating agent may be a polyisobutene-substituted succinic anhydride, the polyisobutene substituent having a number average molecular weight of about 1,500 to about 3,000, and in one embodiment about 1,800 to about 2,300. This first polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The amine used in this first fuel-soluble product (i)(a) may be an alkanol amine and the product may be in the form of an ester/salt. The second hydrocarbyl-substituted carboxylic acid acylating agent may be a polyisobutene-substituted succinic anhydride, the polyisobutene substituent of said second polyisobutene-substituted succinic anhydride having a number average molecular weight of about 700 to about 1,300, and in one embodiment about 800 to about 1,000. This second polyisobutene-substituted succinic anhydride may be characterized by about 1.0 to about 1.3, and in one embodiment about 1.0 to about 1.2 succinic groups per equivalent weight of the polyisobutene substituent. The amine used in this second fuel-soluble product (i)(b) may be an alkanol amine and the product may be in the form of an ester/salt, or the amine may be an alkylene polyamine and the product may be in the form of a succinimide. The fuel-soluble product (i) may be comprised of: about 1% to about 99% by weight, and in one embodiment about 30% to about 70% by weight of the product (i)(a); and about 99% to about 1% by weight, and in one embodiment about 70% to about 30% by weight of the product (i)(b).

In another embodiment, component (i) is a combination of (i)(a) at least one reaction product of an acylating agent with an alkanol amine and (i)(b) at least one reaction product of an acylating agent with at least one ethylene polyamine.

In this embodiment, component (i)(a) is a hydrocarbon fuel-soluble product made by reacting an acylating agent with alkanol amine, wherein said alkanol amine is preferably a dimethylethanol amine or a diethylethanolamine. Preferably, component (i)(a) is made from a polyisobutylene group having a number average molecular weight (Mn) range of from about 1500 to about 3000, and that is maleinated or succinated in the range from 1.3 up to 2.5.

In an embodiment component (i)(b) is a hydrocarbon fuel-soluble product made by reacting an acylating agent with at least one ethylene polyamine such as TEPA (tetraethylenepentamine), PEHA (pentaethylenehexaamine), TETA (triethylenetetramine), polyamine bottoms, or at least one heavy polyamine. The ethylene polyamine can be condensed to form a succinimide. In another embodiment the ethylene polyamine can form a succinimide, by carrying out an imidation reaction at temperatures in the range of about 60° C. to about 250° C.

The equivalent ratio of the reaction for CO:N is from 1:1.5 to 1:0.5, more preferably from 1:1.3 to 1:0.70, and most preferably from 1:1 to 1:0.70, wherein CO:N is the carbonyl to amine nitrogen ratio. Also, component (i)(b) is preferably made from a polyisobutylene group having a number average molecular weight of from about 700 to about 1300 and that is succinated in the range from 1.0 up to 1.3.

The polyamines useful in reacting with the acylating agent for component (i)(b) can be aliphatic, cycloaliphatic, heterocyclic or aromatic compounds. Especially useful are the alkylene polyamines represented by the formula:

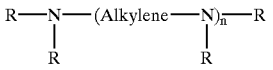

wherein n is from 1 to about 10, preferably from 1 to about 7; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 50 carbon atoms, and in one embodiment up to about 30 carbon atoms; and the "Alkylene" group has from 1 to about 18 carbon atoms, and in one embodiment from 1 to about 6 carbon atoms.

Heavy polyamines typically result from stripping of polyamine mixtures, to remove lower molecular weight polyamines and volatile components, to leave, as residue, what is often termed "polyamine bottoms". In general, alkylene polyamine bottoms can be characterized as having less than 2%, usually less than 1% (by weight) material boiling below about 200° C. In the instance of ethylene polyamine bottoms, which are readily available and found to be quite useful, the bottoms contain less than about 2% (by weight) total diethylenetriamine (DETA) or triethylenetetramine (TETA), as set forth in U.S. Pat. No. 5,912,213, incorporated herein by reference in its entirety. A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample showed it contains about 0.93% "Light Ends" (most probably diethylenetriamine), 0.72% triethylene tetramine, 21.74% tetraethylenepentamine and 76.61% pentaethylenehexamine and higher (by weight). Another commercially available sample is from Union Carbide, known as HPA-X®. These alkylene polyamine bottoms include cyclic condensation products such as piperazine and higher analogs of diethylenetriamine, triethylenetetramine and the like.

The term "heavy polyamine" can also refer to a polyamine that contains 7 or more nitrogens per molecule, or polyamine oligomers containing 7 or more nitrogens per molecule and with 2 or more primary amines per molecule, for example, as set forth in European Patent No. EP 0770098, incorporated herein by reference in its entirety.

In another embodiment, both i(a) and i(b) can each made from a higher molecular weight polyisobutylene group (meaning Mn greater than or equal to about 1,500, preferably from about 1,500 to about 3,000). In an alternative embodiment, components i(a) and i(b) can each made from a lower molecular weight polyisobutylene group (meaning Mn less than or equal to about 1,300, preferably from about 700 to 1,300).

In another embodiment, component i(a) is made from a polyisobutylene group having a number average molecular weight range of from about 700 to about 1,300, and component i(b) is made from a polyisobutylene group having a Mn range of from about 1,500 to about 3,000.

Preferably, component (i)(b) is made by reacting a succinic acylating agent with a polyamine at a sufficient temperature to remove water and form a succinimide.

Preferably, component (i)(b) is combined with component (i)(a) in an amount from about 0.05% to about 0.95% based upon the total weight of component (i).

In another embodiment, the hydrocarbon fuel-soluble product (i) is a salt composition comprised of more than one hydrocarbyl-substituted carboxylic acid acylating agent, for example, a polycarboxylic acylating agent, (I) a first polycarboxylic acylating agent having at least one hydrocarbyl substituent of about 20 to about 500 carbon atoms, (II) a second polycarboxylic acylating agent, said second polycarboxylic acylating agent optionally having at least one hydrocarbyl substituent of up to about 500 carbon atoms, said polycarboxylic acylating agents (I) and (II) being coupled together by a linking group (III) derived from a linking compound having two or more primary amino groups, two or more secondary amino groups, at least one primary amino group and at least one secondary amino group, at least two hydroxyl groups, or at least one primary or secondary amino group and at least one hydroxyl groups, said polycarboxylic acylating agents (I) and (II) forming a salt with (IV) ammonia or an amine.

The hydrocarbyl substituent of the first acylating agent (I) may have about 30 to about 500 carbon atoms, and in one embodiment about 40 to about 500 carbon atoms, and in one embodiment about 50 to about 500 carbon atoms.

The optional hydrocarbyl substituent of the second acylating agent (II) may have 1 to about 500 carbon atoms, and in one embodiment about 6 to about 500 carbon atoms, and in one embodiment about 12 to about 500 carbon atoms, and in one embodiment about 18 to about 500 carbon atoms, and in one embodiment about 24 to about 500 carbon atoms, and in one embodiment about 30 to about 500 carbon atoms, and in one embodiment about 40 to about 500 carbon atoms, and in one embodiment about 50 to about 500 carbon atoms.

The hydrocarbyl substituent of the second acylating agent (II) may be derived from an alpha-olefin or an alpha-olefin fraction. The alpha-olefins include 1-dodecene, 1-tridecene, 1-tetradecene, 1-pentadecene, 1-hexadecene, 1-heptadecene, 1-octadecene, 1-eicosene, 1-docosene, 1-triacontene, and the like. The alpha olefin fractions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and the like. Mixtures of two or more of any of the foregoing alpha-olefins or alpha-olefin fractions may be used.

The hydrocarbyl groups of the first and second acylating agents (I) and (II) independently may be derived from an olefin oligomer or polymer. The olefin oligomer or polymer may be derived from an olefin monomer of 2 to about 10 carbon atoms, and in one embodiment about 3 to about 6 carbon atoms, and in one embodiment about 4 carbon atoms. Examples of the monomers include ethylene; propylene; butene-1; butene-2; isobutene; pentene-1; heptene-1; octene-1; nonene-1; decene-1; pentene-2; or a mixture of two of more thereof.

The hydrocarbyl groups of the first and/or second acylating agents (I) and (II) independently may be polyisobutene groups of the same or different molecular weights. Either or both of the polyisobutene groups may be made by the polymerization of a $C_4$ refinery stream having a butene content of about 35 to about 75% by weight and an isobutene content of about 30 to about 60% by weight.

The hydrocarbyl groups of the first and/or second acylating agents (I) and (II) independently may be polyisobutene groups derived from a polyisobutene having a high methylvinylidene isomer content, that is, at least about 50% by weight, and in one embodiment at least about 70% by weight methylvinylidenes. Suitable high methylvinylidene polyisobutenes include those prepared using boron trifluoride catalysts. The preparation of such polyisobutenes in which the methylvinylidene isomer comprises a high percentage of the total olefin composition is described in U.S. Pat. Nos. 4,152,499 and 4,605,808, the disclosure of each of which are incorporated herein by reference. An advantage of using these high methylvinylidene isomers is that the acylating agents (I) and (II) can be formed using a chlorine-free process which is significant when the fuel composition to which they are to be added is required to be a chlorine-free or low-chlorine fuel.

In one embodiment, each of the hydrocarbyl substituents of each of the acylating agents (I) and (II) is a polyisobutene group, and each polyisobutene group independently has a number average molecular weight in the range of about 500 to about 3000, and in one embodiment about 900 to about 2400.

The hydrocarbyl substituent of the acylating agent (I) may be a polyisobutene group having a number average molecular weight of about 2,000 to about 2,600, and in one embodiment about 2,200 to about 2,400, and in one embodiment about 2,300. The hydrocarbyl substituent of the acylating agent (II) may be a polyisobutene group having a number average molecular weight of about 700 to about 1,300, and in one embodiment about 900 to about 1,100, and in one embodiment about 1,000.

The linking group (III) for linking the first acylating agent (I) with the second acylating agent (II) may be derived from a polyol, a polyamine or a hydroxyamine. The polyol may be a compound represented by the formula $$R—(OH)_m$$

wherein in the foregoing formula, R is an organic group having a valency of m, R is joined to the OH groups through carbon-to-oxygen bonds, and m is an integer from 2 to about 10, and in one embodiment 2 to about 6. The polyol may be a glycol. The alkylene glycols are useful. Examples of the polyols that may be used include ethylene glycol, diethylene glycol, triethylene glycol, tetraethylene glycol, propylene glycol, dipropylene glycol, tripropylene glycol, dibutylene glycol, tributylene glycol, 1,2-butanediol, 2,3-dimethyl-2,3-butanediol, 2,3-hexanediol, 1,2-cyclohexanediol, pentaerythritol, dipentaerythritol, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,6,6-tetrakis-(hydroxymethyl) cyclohexanol, 1,10-decanediol, digitalose, 2-hydroxymethyl-2-methyl-1,3-propanediol-(tri-methylethane), or 2-hydroxymethyl-2-ethyl-1,3-propanediol-(trimethylpropane), and the like. Mixtures of two or more of the foregoing can be used.

The polyamines useful as linking compounds (III) for linking the acylating agents (I) and (II) may be aliphatic, cycloaliphatic, heterocyclic or aromatic compounds. Especially useful are the alkylene polyamines represented by the formula:

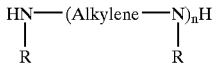

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. Specific examples of such polyamines include ethylene diamine, triethylene tetramine, propylene diamine, trimethylene diamine, tripropylene tetramine, tetraethylene pentamine, hexaethylene heptamine, pentaethylene hexamine, or a mixture of two or more thereof.

Ethylene polyamines, such as some of those mentioned above, are useful as the linking compounds (III). Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring-opening reagent such as water, ammonia, etc. These reactions result in the production of a complex mixture of polyalkylene polyamines including cyclic condensation products such as piperazines.

The hydroxyamines useful as linking compounds (III) for linking the acylating agents (I) and (II) may be primary or secondary amines. The terms "hydroxyamine" and "aminoalcohol" describe the same class of compounds and, therefore, can be used interchangeably. In one embodiment, the hydroxyamine is (a) an N-(hydroxyl-substituted hydrocarbyl) amine, (b) a hydroxyl-substituted poly (hydrocarbyloxy) analog of (a), or a mixture of (a) and (b). The hydroxyamine may began alkanol amine containing from 1 to about 40 carbon atoms, and in one embodiment 1 to about 20 carbon atoms, and in one embodiment 1 to about 10 carbon atoms.

The hydroxyamines useful as the linking compounds (III) may be a primary or secondary amines, or a mixture of two or more thereof. These hydroxyamines may be represented, respectfully, by the formulae:

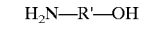

or

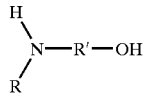

wherein each R is independently a hydrocarbyl group of one to about eight carbon atoms or hydroxyl-substituted hydrocarbyl group of two to about eight carbon atoms and R' is a divalent hydrocarbon group of about two to about 18 carbon atoms. Typically each R is a lower alkyl group of up to seven carbon atoms. The group —R'—OH in such formulae represents the hydroxyl-substituted hydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group.

The hydroxyamines useful as the linking compound (III) may be ether N-(hydroxy-substituted hydrocarbyl) amines. These may be hydroxyl-substituted poly(hydrocarbyloxy) analogs of the above-described hydroxyamines (these analogs also include hydroxyl-substituted oxyalkylene analogs). Such N-(hydroxyl-substituted hydrocarbyl) amines may be conveniently prepared by reaction of epoxides with afore-described amines and may be represented by the formulae:

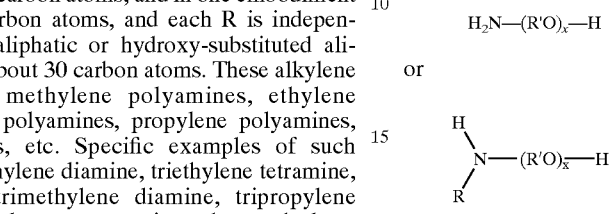

or wherein x is a number from about 2 to about 15, and R and R' are as described above.

The hydroxyamine useful as the linking compound (III) for linking the acylating agents (I) and (II) may be one of the hydroxy-substituted primary amines described in U.S. Pat. No. 3,576,743 by the general formula

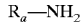

wherein $R_a$ is a monovalent organic group containing at least one alcoholic hydroxy group. The total number of carbon atoms in $R_a$ preferably does not exceed about 20. Hydroxy-substituted aliphatic primary amines containing a total of up to about 10 carbon atoms are useful. The polyhydroxy-substituted alkanol primary amines wherein there is only one amino group present (i.e., a primary amino group) having one alkyl substituent containing up to about 10 carbon atoms and up to about 6 hydroxyl groups are useful. These alkanol primary amines correspond to $R_a$—$NH_2$ wherein $R_a$ is a mono-O or polyhydroxy-substituted alkyl group. It is desirable that at least one of the hydroxyl groups be a primary alcoholic hydroxyl group. Specific examples of the hydroxy-substituted primary amines include 2-amino-1-butanol, 2-amino-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxypropyl)-N'-(beta-aminoethyl)-piperazine, tris-(hydroxymethyl) aminomethane (also known as trismethylolaminomethane), 2-amino-butanol, ethanolamine, beta-(beta-hydroxyethoxy)-ethylamine, glucamine, glusoamine, 4-amino-3-hydroxy-3-methyl-1-butene (that can be prepared according to procedures known in the art by reacting isopreneoxide with ammonia), N-3 (aminopropyl)-4-(2-hydroxyethyl)-piperadine, 2-amino-6-methyl-6-heptanol, 5-amino-1-pentanol, N-(beta-hydroxyethyl)-1,3-diamino propane, 1,3-diamino-2-hydroxypropane, N-(beta-hydroxy ethoxyethyl)-ethylenediamine, trismethylol aminomethane and the like.

Hydroxyalkyl alkylene polyamines having one or more hydroxyalkyl substituents on the nitrogen atoms may be used as the linking compound (III) for linking the acylating agents (I) and (II). Useful hydroxyalkyl-substituted alkylene polyamines include those in which the hydroxyalkyl group is a lower hydroxyalkyl group, i.e., having less than eight carbon atoms.

Examples of such hydroxyalkyl-substituted polyamines include N-(2-hydroxyethyl) ethylene diamine, N,N-bis(2-hydroxyethyl) ethylene diamine, 1-(2-hydroxyethyl)- piperazine, monohydroxypropyl-substituted diethylene triamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino groups or through hydroxy groups are likewise useful. Condensation through amino groups results in a higher amine accompanied by removal of ammonia and condensation through the hydroxy groups results in products containing ether linkages accompanied by removal of water.

The amines (IV) which are useful along with ammonia in forming a salt with the acylating agents (I) and (II) include the amines and hydroxyamines discussed above as being useful as linking compounds (III) for linking the acylating agents (I) and (II). Also included are primary and secondary monoamines, tertiary mono- and polyamines, and tertiary alkanol amines. The tertiary amines are analogous to the primary amines, secondary amines and hydroxyamines discussed above with the exception that they may be either monoamines or polyamines and the hydrogen atoms in the H—N< or —$NH_2$ groups are replaced by hydrocarbyl groups.

The monoamines useful as the amines (IV) for forming a salt with the acylating agents (I) and (II) may be represented by the formula

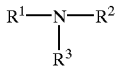

wherein $R^1$, $R^2$ and $R^3$ are the same or different hydrocarbyl groups. Preferably, $R^1$, $R^2$ and $R^3$ are independently hydrocarbyl groups of from 1 to about 20 carbon atoms, and in one embodiment from 1 to about 10 carbon atoms. Examples of useful tertiary amines include trimethylamine, triethylamine, tripropylamine, tributylamine, monomethyldiethylamine, monoethyldimethylamine, dimethylpropylamine, dimethylbutylamine, dimethylpentylamine, dimethylhexylamine, dimethylheptylamine, dimethyloctyl amine, dimethylnonyl amine, dimethyldecyl amine, dimethylphenyl amine, N,N-dioctyl-1-octanamine, N,N-didodecyl-1-dodecanamine, tricocoamine, trihydrogenated-tallowamine, N-methyl-dihydrogenated-tallowamine, N,N-dimethyl-1-dodecanamine, N,N-dimethyl-1-tetradecanamine, N,N-dimethyl-1-hexadecanamine, N,N-dimethyl 1-octadecanamine, N,N-dimethylcocoamine, N,N-dimethylsoyaamine, N,N-dimethylhydrogenated-tallowamine, etc.

Tertiary alkanol amines which are useful as the amines (IV) for forming a salt with the acylating agents (I) and (II) include those represented by the formula:

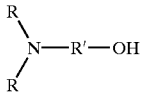

wherein each R is independently a hydrocarbyl group of one to about eight carbon atoms or hydroxyl-substituted hydrocarbyl group of two to about eight carbon atoms and R' is a divalent hydrocarbyl group of about two to about 18 carbon atoms. The groups —R'—OH in such formula represents the hydroxyl-substituted hydrocarbyl groups. R' may be an acyclic, alicyclic or aromatic group. Typically, R' is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines, and the like. Typically, however, each R is a low alkyl group of up to seven carbon atoms. A useful hydroxyamine is dimethylaminoethanol. The hydroxyamines can also be ether N-(hydroxy-substituted hydrocarbyl)amines. These are hydroxyl-substituted poly(hydrocarbyloxy) analogs of the above-described hydroxy amines (these analogs also include hydroxyl-substituted oxyalkylene analogs). Such N-(hydroxyl-substituted hydrocarbyl) amines can be conveniently prepared by reaction of epoxides with afore-described amines and can be represented by the formula:

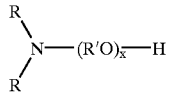

wherein x is a number from about 2 to about 15 and R and R' are described above.

Polyamines which are useful as the amines (IV) for forming a salt with the acylating agents (I) and (II) include the alkylene polyamines discussed above as well as alkylene polyamines with only one or no hydrogens attached to the nitrogen atoms. Thus, the alkylene polyamines useful as the amine (IV) include those conforming to the formula:

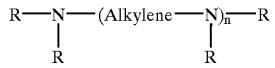

wherein n is from 1 to about 10, preferably from 1 to about 7; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 50 carbon atoms, and in one embodiment up to about 30 carbon atoms; and the "Alkylene" group has from 1 to about 18 carbon atoms, and in one embodiment from 1 to about 6 carbon atoms.

These hydrocarbon fuel-soluble salt compositions may be prepared by initially reacting the acylating agents (I) and (II) with the linking compound (III) to form an intermediate, and thereafter reacting the intermediate with the ammonia or amine (IV) to form the desired salt. An alternative method involves reacting the acylating agent (I) and ammonia or amine (IV) with each other to form a first salt moiety, separately reacting the acylating agent (II) and ammonia or amine (IV) (which can be the same or different ammonia or amine reacted with the acylating agent (I)) with each other to form a second salt moiety, then reacting a mixture of these two salt moieties with the linking compound (III).

The ratio of reactants utilized in the preparation of these salt compositions may be varied over a wide range. Generally, for each equivalent of each of the acylating agents (I) and (II), at least about one equivalent of the linking compound (III) is used. From about 0.1 to about 2 equivalents or more of ammonia or amine (IV) are used for each equivalent of the acylating agents (I) and (II), respectively. The upper limit of linking compound (III) is about 2 equivalents of linking compound (III) for each equivalent of acylating agents (I) and (II). Generally the ratio of equivalents of acylating agent (I) to the acylating agent (II) is about 0.5 to about 2, with about 1:1 being useful. Useful amounts of the reactants include about 2 equivalents of the linking compound (III), and from about 0.1 to about 2 equivalents of the ammonia or amine (IV) for each equivalent of each of the acylating agents (I) and (I).

The number of equivalents of the acylating agents (I) and (II) depends on the total number of carboxylic functions present in each. In determining the number of equivalents for each of the acylating agents (I) and (II), those carboxyl functions which are not capable of reacting as a carboxylic acid acylating agent are excluded. In general, however, there is one equivalent of each acylating agent (I) and (II) for each carboxy group in the acylating agents. For example, there would be two equivalents in an anhydride derived from the reaction of one mole of olefin polymer and one mole of maleic anhydride.

The weight of an equivalent of a polyamine is the molecular weight of the polyamine divided by the total number of nitrogens present in the molecule. If the polyamine is to be used as linking compound (III), tertiary amino groups are not counted. One the other hand, if the polyamine is to used as a salt forming amine (IV), tertiary amino groups are counted. The weight of an equivalent of a commercially available mixture of polyamines can be determined by dividing the atomic weight of nitrogen (14) by the % N contained in the polyamine; thus, a polyamine mixture having a % N of 34 would have an equivalent weight of 41.2. The weight of an equivalent of ammonia or a monoamine is equal to its molecular weight.

The weight of an equivalent of a polyol is its molecular weight divided by the total number of hydroxyl groups present in the molecule. Thus, the weight of an equivalent of ethylene glycol is one-half its molecular weight.

The weight of an equivalent of a hydroxyamine which is to be used as a linking compound (III) is equal to its molecular weight divided by the total number of —OH, >NH and —$NH_2$ groups present in the molecule. On the other hand, if the hydroxyamine is to be used as a salt forming amine (IV), the weight of an equivalent thereof would be its molecular weight divided by the total number of nitrogen groups present in the molecule.

The acylating agents (I) and (II) may be reacted with the linking compound (III) according to conventional ester and/or amide-forming techniques. This normally involves heating acylating agents (I) and (II) with the linking compound (III), optionally in the presence of a normally liquid, substantially inert, organic liquid solvent/diluent. Temperatures of at least about 30° C. up to the decomposition temperature of the reaction component and/or product having the lowest such temperature can be used. This temperature may be in the range of about 50° C. to about 130° C., and in one embodiment about 80° C. to about 100° C. when the acylating agents (I) and (II) are anhydrides. On the other hand, when the acylating agents (I) and (II) are acids, this temperature is typically in the range of about 100° C. to about 300° C. with temperatures in the range of about 125° C. to about 250° C. often being employed.

The product made by this reaction is typically in the form of statistical mixture that is dependent on the charge of each of the acylating agents (I) and (II), and on the number of reactive sites on the linking compound (III). For example, if an equal molar ratio of acylating agents (I) and (II) is reacted with ethylene glycol, the product would be comprised of a mixture of (1) 50% of compounds wherein one molecule the acylating agent (I) is linked to one molecule of the acylating agent (II) through the ethylene glycol; (2) 25% of compounds wherein two molecules of the acylating agent (I) are linked together through the ethylene glycol; and (3) 25% of compounds wherein two molecules of the acylating agent (II) are linked together through the ethylene glycol.

The reactions between the acylating agents (I) and (II), and the salt forming ammonia or amine (IV) are carried out under salt forming conditions using conventional techniques. Typically, these components are mixed together and heated to a temperature in the range of about 20° C. up to the decomposition temperature of the reaction component and/or product having the lowest such temperature, and in one embodiment about 50° C. to about 130° C., and in one embodiment about 80 C. to about 110° C.; optionally, in the presence of a normally liquid, substantially inert organic liquid solvent/diluent, until the desired salt product has formed.

The fuel-soluble product (i) may be present in the water-fuel emulsion at a concentration of up to about 15% by weight based on the overall weight of the emulsion, and in one embodiment about 0.1 to about 15% by weight, and an one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The Ionic or Nonionic Compound (ii)

The ionic or nonionic compound (ii) has a hydrophilic-lipophilic balance (HLB, which refers to the size and strength of the polar (hydrophilic) and non-polar (lipophilic) groups on the surfactant molecule) in the range of about 1 to about 40, and in one embodiment about 4 to about 15. Examples of these compounds are disclosed in *McCutcheon's Emulsifiers and Detergents*, 1998, North American & International Edition. Pages 1–235 of the North American Edition and pages 1–199 of the International Edition are incorporated herein by reference for their disclosure of such ionic and nonionic compounds having an HLB in the range of about 1 to about 40, in one embodiment about 1 to about 30, in one embodiment about 1 to 20, and in another embodiment about 1 to about 10. Useful compounds include alkanolamides, carboxylates including amine salts, metallic salts and the like, alkylarylsulfonates, amine oxides, poly (oxyalkylene) compounds, including block copolymers comprising alkylene oxide repeat units, carboxylated alcohol ethoxylates, ethoxylated alcohols, ethoxylated alkyl phenols, ethoxylated amines and amides, ethoxylated fatty acids, ethoxylated fatty esters and oils, fatty esters, fatty acid amides, including but not limited to amides from tall oil fatty acids and polyamides (3066), glycerol esters, glycol esters, sorbitan esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkyl phenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

In one embodiment, the ionic or nonionic compound (ii) is a fuel-soluble product made by reacting an acylating agent having about 12 to about 30 carbon atoms with ammonia or an amine. The acylating agent may contain about 12 to about 24 carbon atoms, and in one embodiment about 12 to about 18 carbon atoms. The acylating agent may be a carboxylic acid or a reactive equivalent thereof. The reactive equivalents include acid halides, anhydrides, esters, and the like. These acylating agents may be monobasic acids or polybasic acids. The polybasic acids are preferably dicarboxylic, although tri- and tetra-carboxylic acids may be used. These acylating agents may be fatty acids. Examples include myristic acid, palmitic acid, stearic acid, oleic acid, linoleic acid, linolenic acid, and the like. These acylating agents may be succinic acids or anhydrides represented, respectively, by the formulae

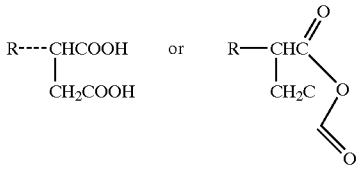

wherein each of the foregoing formulae R is a hydrocarbyl group of about 10 to about 28 carbon atoms, and in one embodiment about 12 to about 20 carbon atoms. Examples include tetrapropylene-substituted succinic acid or anhydride, hexadecyl succinic acid or anhydride, and the like. The amine may be any of the amines described above as being useful in making the fuel-soluble product (i). The amines include but are not limited to the reaction product between the fatty acid and the amine. The fatty acid includes but is not limited to tall oil fatty acid which is a mixture of $C_{12}$–$C_{20}$ fatty acids, the majority of which are unsaturated, more particularly linoleic acid, oleic acid, linolenic acid and the like. The amines include but are not limited to polyamines, such as heavy polyamine aromatic polyamines such as 3-amino-pyridine, N-13-aminopropyl imidazole and the like.

The product of the reaction between the acylating agent and the ammonia or amine may be a salt, an ester, an amide, an imide, or a combination thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. The reaction between the acylating agent and the ammonia or amine is carried out under conditions that provide for the formation of the desired product. Typically, the acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the acylating agent and the ammonia or amine are reacted in amounts sufficient to provide from about 0.3 to about 3 equivalents of acylating agent per equivalent of ammonia or amine. In one embodiment, this ratio is from about 0.5:1 to about 2:1, and in one embodiment about 1:1.

In one embodiment, the ionic or nonionic compound (ii) is an ester/salt made by reacting hexadecyl succinic anhydride with dimethylethanol amine in an equivalent ratio (i.e., carbonyl to amine ratio) of about 1:1 to about 1:1.5, and in one embodiment about 1:1.35.

The ionic or nonionic compound (ii) may be present in the water fuel emulsion at a concentration of up to about 15% by weight, and in one embodiment about 0.01 to about 15% by weight, and in one embodiment about 0.01 to about 10% by weight, and one embodiment about 0.01 to about 5% by weight, and in one embodiment about 0.01 to about 3% by weight, and in one embodiment about 0.1 to about 1% by weight.

The Water-Soluble Compound

The water-soluble compound may be an amine salt, ammonium salt, azide compound, nitro compound, alkali metal salt, alkaline earth metal salt, or mixtures of two or more thereof. These compounds are distinct from the fuel-soluble product (i) and the ionic or nonionic compound (ii) discussed above. These water-soluble compounds include organic amine nitrates, nitrate esters, azides, nitramines and nitro compounds. Also included are alkali and alkaline earth metal carbonates, sulfates, sulfides, sulfonates, and the like.

Particularly useful are the amine or ammonium salts represented by the formula $$k[G(NR_3)_y]^{y+}nX^{p-}$$

wherein G is hydrogen or an organic group of 1 to about 8 carbon atoms, and in one embodiment 1 to about 2 carbon atoms, having a valence of y; each R independently is hydrogen or a 20-hydrocarbyl group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, ammonium acetate, methylammonium nitrate, methylammonium acetate, ethylene diamine diacetate, urea nitrate, urea and guanidinium nitrate. Ammonium nitrate is particularly useful.

In one embodiment, the water-soluble compound functions as an emulsion stabilizer, i.e., it acts to stabilize the water-fuel emulsion. Thus, in one embodiment, the water-soluble compound is present in the water fuel emulsion in an emulsion-stabilizing amount.

In one embodiment, the water-soluble compound functions as a combustion improver. A combustion improver is characterized by its ability to increase the mass burning rate of the fuel composition. The presence of such a combustion improver has the effect of improving the power output of an engine. Thus, in one embodiment, the water-soluble compound is present in the water-fuel emulsion in a combustion-improving amount.

The water-soluble compound may be present in the water-fuel emulsion at a concentration of about 0.001 to about 1% by weight, and in one embodiment from about 0.01 to about 1% by weight.

Emulsifier v

In one embodiment the emulsifier (v) is the reaction product of A) a polyacidic polymer, B) at least one fuel soluble product made by reacting at least one hydrocarbyl-substituted carboxylic acid acylating agent, and C) a hydroxy amine and/or a polyamine.

The fuel soluble product is made by reacting at least one hydrocarbyl-substituted carboxylic agent with a hydroxy amine and/or polyamine and is described earlier in the specification.

The polyacidic polymers used in the reaction include but are not limited to $C_4$ to $C_{30}$, preferably $C_8$ to $C_{20}$ olefin/maleic anhydride copolymers. The alpha-olefins include 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-eicosene, 1-docosene, 1-triacontene, and the like. the alpha olefin fractions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and the like. Mixtures of two or more of any of the foregoing alpha-olefins or alpha-olefin fractions may be used.

Other polyacidic polymers suitable for reaction include but are not limited to maleic anhydride/styrene copolymers; poly-maleic anhydride; acrylic and methacrylic acid containing polymers; poly-(alkyl)acrylates; reaction products of maleic anhydride with polymers with multiple double bonds; and combinations thereof. The preferred is polyacidic polymer $C_{18}$[1-octadecene]/maleic anhydride copolymer.

In another embodiment the polyacidic polymer is a copolymer of an olefin and a monomer having the structure:

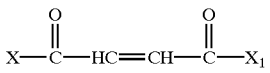

(I)

wherein X and X1 are the same or different provided that at least one of X and $X_1$ is such that the copolymer can function as a carboxylic acylating agent.

The copolymer of an olefin and a monomer having the structure (I) is produced by copolymerization of olefin and monomer having the structure I. The olefin:monomer molar ratio in the copolymer is preferably 1:2 to 2:1, more preferable about 1:1.

As regards the olefin, this may be any polymerizable olefin characterized by the presence of one or more ethylenically unsaturated groups. The olefin may be either a terminal olefin or an internal olefin, preferably a terminal olefin. Although it is preferred to employ olefinic hydrocarbons, the olefin may contain nonhydrocarbon groups, for example, alkoxy or hydroxy groups. Examples of suitable olefin monomers include but are not limited to 1-hexene, octadecene-1 and diisobutylene. The olefin preferably is a $C_4$–$C_{30}$ olefin.

As regards the monomer having the structure (I), at least one and preferably both X and $X_1$ must be such that the copolymer can esterify alcohols, form amides or amine salts with ammonia or amines, form metal salts with reactive metals or basically reacting metal compounds, and otherwise function as a conventional carboxylic acid acylating agent. Thus X and/or $X_1$ can be —OH, —O-hydrocarbyl, —$NH_2$, —Cl., Br. or together can be an oxygen atom so as to form the anhydride. Preferably X and/or $X_1$ are either —OH or together are an oxygen atom, more preferably X and $X_1$ are together an oxygen atom, i.e., the monomer having the structure (I) is maleic anhydride.

A range of suitable olefin/monomer copolymers wherein the monomers have the structure (I) are commercially available, include but are not limited to (a) a copolymer of an olefin such as polyoctadecene-1 and a monomer having the structure:

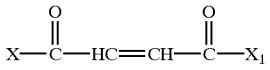

wherein X and $X_1$ are the same or different provided that at least one of X and $X_1$ is such that the copolymer can function as a carboxylic acylating agent, The copolymer of octadecene-1 and maleic anhydride, the copolymer having a number average molecular weight from greater than 6,300 to less than 12,000. Preferably the number average molecular weight of the copolymer is in the range from greater than 6,300 to 11,200, more preferably from 6,650 to 8,050, corresponding to an average number of recurring units preferably in the range from greater than 18 to 32, more preferably from 19 to 23. It is understood that such a copolymer is produced by the alternating copolymerization of octadecene-1 and maleic anhydride as opposed to the reaction of maleic anhydride with a preformed polymer of octadecene-1. The copolymers are readily prepared by the copolymerization of maleic anhydride and octadecene-1 by refluxing the two together in a hydrocarbon solvent in the presence of a free radical polymerization initiator. A suitable method is described in, for example, BG-A-1,121,464 (Monsanto Co.)

The molecular weight of the copolymer is preferably in the range 2,000 to 50,000, typically about 5,000 to 30,000. A preferred copolymer is a copolymer of polyoctadecene-1 and maleic anhydride. This can be readily prepared by refluxing a mixture of octadecene-1 and maleic anhydride in a hydrocarbon solvent in the presence of a free radical polymerization initiator. A suitable method is described in, for example, GB-A-1,121,464 (Monsanto Co.).

The emulsifier (v) useful for this invention is made by reacting A.) a polyacidic polymer, B) at least one fuel soluble product made by reacting at least one hydrocarbyl-substituted carboxylic acid acylating agent and C) a hydroxy amine and/or a polyamine.

In another embodiment the emulsifier is made by mixing the emulsifier of the reaction of A, B and C above with at least one of an ionic or a non-ionic compound having a hydrophilic-lipophilic balance of about 1 to about 40.

In another embodiment the emulsifier is made by mixing the emulsifier of the reaction product of A and B above with a water soluble compound selected from the group consisting of amine salt, ammonium salts, azide compounds, nitrate esters, nitramine, nitro compounds, alkali metal salts, alkaline salt metals and combinations thereof.

The reaction of polyacidic polymer with the fuel soluble product (i) with the (B) at least one fuel soluble product made by reacting at least one hydrocarbyl-substituted carboxylic acid acylating agent with a hydroxy amine and/or a polyamine, is carried out as a condensation or condensation-polymerization reaction which may take the form of an emulsion, solution, suspension, continuous addition bulk or the like. This reaction can be carried out as a batch, semi-batch, a continuous process or the like.

In one embodiment, a polyamine is added to a stirred flask containing a mixture of polyacidic polymer, hydrocarbyl-substituted carboxylic acid acylating agent and diluent or solvent at elevated temperature. In another embodiment, the fuel soluble product is formed in an initial step. The fuel soluble product may, or may not contain solvent. Polyacidic polymer is then added to a stirred flask containing the fuel soluble product and the reaction temperature is raised. In either embodiment, the reaction is stirred at elevated temperature for a period of time until reaction is deemed complete, and the product is then collected. The reaction temperature may be in the range of about 60° C. and about 250° C., preferably in the range of about 100° C. and about 200° C. and more preferably in the range of about 120° C. and about 170° C. The reaction may be carried out at elevated or reduced pressure, but is preferably carried out at atmospheric or slightly below atmospheric pressure. The reaction may be carried out over any period from about 30 minutes to about 24 hours, preferably about 2 to about 8 hours and more preferably 3–5 hours.

The emulsifier produced from the reaction product of the polyacidic polymer with the fuel soluble product (i) comprises about 25% to about 95% of fuel soluble product and about 0.1% to about 50% of the polyacidic polymer; preferably about 50% to about 92% fuel soluble product and about 1% to about 20% of the polyacidic polymer, and most preferably about 70% to about 90% of fuel soluble product and about 5% to about 10% of the polyacidic polymer. In one embodiment the emulsifier is described as a polyalkenyl succinimide crosslinked with an olefin/maleic anhydride copolymer.

The emulsion gives good stability relative to other water fuel emulsifiers. This results in greater long-term stability of the emulsion. There is a overall improvement in emulsion stability relative to existing emulsifiers.

Cetane Improver

In one embodiment, the water-fuel emulsion contains a cetane improver. The cetane improvers that are useful include but are not limited to peroxides, nitrates, nitrites, nitrocarbamates, and the like. Useful cetane improvers include but are not limited to nitropropane, dinitropropane, tetranitromethane, 2-nitro-2-methyl-1-butanol, 2-methyl-2-nitro-1-propanol, and the like. Also included are nitrate esters of substituted or unsubstituted aliphatic or cycloaliphatic alcohols which may be monohydric or polyhydric. These include substituted and unsubstituted alkyl or cycloalkyl nitrates having up to about 10 carbon atoms, and in one embodiment about 2 to about 10 carbon atoms. The alkyl group may be either linear or branched, or a mixture of linear or branched alkyl groups. Examples include methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also useful are the nitrate esters of alkoxy-substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate. A useful cetane improver is 2-ethylhexyl nitrate.

The concentration of the cetane improver in the water-fuel emulsion may be at any concentration sufficient to provide the emulsion with the desired cetane number. In one embodiment, the concentration of the cetane improver is at a level of up to about 10% by weight, and in one embodiment about 0.05 to about 10% by weight, and in one embodiment about 0.05 to about 5% by weight, and in one embodiment about 0.05 to about 1% by weight.

Additional Additives

In addition to the foregoing materials, other fuel additives that are well known to those of skill in the art may be used in the water-fuel emulsions of the invention. These include but are not limited to dyes, rust inhibitors such as alkylated succinic acids and anhydrides, bacteriostatic agents, gum inhibitors, metal deactivators, upper cylinder lubricants, and the like. These additional additives may be used at concentrations of up to about 1% by weight based on the total weight of the water-fuel emulsions, and in one embodiment about 0.01 to about 1% by weight.

The total concentration of chemical additives, including the foregoing emulsifiers, in the water-fuel emulsions of the invention may range from about 0.05 to about 30% by weight, and in one embodiment about 0.1 to about 20% by weight, and in one embodiment about 0.1 to about 15% by weight, and in one embodiment about 0.1 to about 10% by weight, and in one embodiment about 0.1 to about 5% by weight.

Organic Solvent

The additives, including the foregoing emulsifiers, may be diluted with a substantially inert, normally liquid organic solvent such as naphtha, benzene, toluene, xylene or diesel fuel to form an additive concentrate which is then mixed with the fuel and water to form the water-fuel emulsion. These concentrates (extrapolate) generally contain from about 10% to about 90% by weight of the foregoing solvent.

The water-fuel emulsions may contain up to about 60% by weight organic solvent, and in one embodiment about 0.01 to about 50% by weight, and in one embodiment about 0.01 to about 20% by weight, and in one embodiment about 0.1 to about 5% by weight, and in one embodiment about 0.1 to about 3% by weight.

Antifreeze Agent

In one embodiment, the water-fuel emulsions of the invention contain an antifreeze agent. The antifreeze agent is typically an alcohol. Examples include but are not limited to ethylene glycol, propylene glycol, methanol, ethanol, glycerol and mixtures of two or more thereof. The antifreeze agent is typically used at a concentration sufficient to prevent freezing of the water used in the water-fuel emulsions. The concentration is therefore dependent upon the temperature at which the fuel is stored or used. In one embodiment, the concentration is at a level of up to about 20% by weight based on the weight of the water-fuel emulsion, and in one embodiment about 0.1 to about 20% by weight, and in one embodiment about 1 to about 10% by weight.

The Engines

The engines that may be operated in accordance with the invention include all compression-ignition (internal combustion) engines for both mobile (including marine) and stationary power plants including but not limited to diesel, gasoline, and the like. The engines that can be used include but are not limited to those used in automobiles, trucks such as all classes of truck, buses such as urban buses, locomotives, heavy duty diesel engines, stationary engines (how define) and the like. Included are on- and off-highway engines, including new engines as well as in-use engines. These include diesel engines of the two-stroke-per-cycle and four-stroke-per-cycle types.

EXAMPLES

The following examples are presented to illustrate the invention. It should be understood, however, that the invention is not limited to specific details set forth in the examples.

Example 1

The following is an Example of (i) (a).

Charge about 116.09 g of 1000 m. wt. PIBSA and about 192.32 g of 100 neutral oil at about 60° C., to about a 1 liter spherical 4-neck flask, with a temperature controller operating a rheostated heating mantle and a thermocouple in a glass well, 3 speed overhead stirrer system-powered bent glass rod stirrer secured through a glass stirrer bearing, a $N_2$ above surface inlet, and a cold water reflux condenser. The $N_2$ was set at about 0.25 square cubic feet per hour (SCFH), the mixture was stirred at low speed, and the mixture was heated to about 70° C., while 3 increments of about 50% aqueous sodium hydroxide (total 20 ml) was added over about 45 minutes. The mixture was then heated to about 90° C. and then about 45.8 g of 100 neutral oil was added. The mixture then stood overnight. The condenser was removed and the N2 reset at about 0.25 SCFHf and the contents stirred at low speed and heated to about 155° C. over about 1.5 hours to remove water. The final product was a viscous, non-gelled, non-foaming amber liquid emulsifier.

Emulsion Preparation: An emulsion was made per example 5 where in emulsifier 1 was the above and emulsifier 2 was hexadecenyl succinic anhydride/dimethylamiethanol (1:1) m. in the ratio of Solution 1 to 2 was 80:20 and mixed in a Waring blender for about 5 minutes at low speed.

Results:

Key performance tests are the emulsion stability after 7 days at room temperature. Stability was semi-quantitatively evaluated by percent white emulsion in the storage bottle. The water-blended fuel emulsion results showed no separated water after one week at room temperature. These results demonstrate the emulsifier in water blended fuels produces a stable water diesel fuel emulsion suitable for combustion in diesel engines.

Example 2

The following Example 2 illustrates hydrocarbon fuel soluble product (i).

The emulsifier was prepared by mixing about 679.93 g of poly-iso-butene succinic anhydride and about 23.52 g of heavy amine bottoms available from Union Carbide at about 110° C. for about 20 minutes in a dropping funnel. The reaction vessel was slowly purged with nitrogen to atmosphere. The mixture was then held at about 110° C. for about 4 hours and then decanted.

The poly-iso-butene succinic anhydride was prepared by heating with maleic anhydride and 2,300 m. wt. polyisobutylene (available as Glissopal 2300 from BASF).

The procedure for emulsion preparation was per example 5. Emulsifier 1 was the emulsifier prepared in this example. Emulsifier 2 was hexadecenyl succinic anhydride/dimethylaminoethanol (1:1)m. The ratio of solution 1 to solution 2 was 86.65:13.35 and was mixed in the Waring blender for 6 minutes at high speed.

The water blended fuel after 7 days gave no water separation.

Example 3

The following example is provided to illustrate the preparation of component (ii).

About 141.5 g (0.5 mole), 1 equivalent) of tall oil fatty acid and about 62.6 g (0.5 mole, 1 equivalent) of aminopropyl imidazole was charged into about a 500 ml flask equipped with a thermocouple/Eurotherm/heating mantle, mechanical stirrer, Dean-Stark trap and condenser. The glassware between the mantle and condenser were wrapped with glass wool. The reactor contents were heated with stirring to about 175° C. over about 20 minutes and then held at that temperature for about 3 hours, about 5.6 g of water was collected. The emulsifier product was cooled and weighed to provide about 181 g.

The procedure for emulsion preparation was per Example 5. Emulsifier 1 was 2000 molecular weight polyisobutylene succinic anhydride/dimethylaminoethanol (1C═O:1N)Eq. The emulsifier prepared in this Example was used as emulsifier 2. The ratio of Solution 1 to Solution 2 was 86.65:13.35 and was mixed in the Waring Blender for 6 minutes at high speed.

Key performance tests are the emulsion stability after 7 days at room temperature. The water-blended fuel emulsion gave no separation after 7 days.

Example 4

The following example is provided to illustrate the preparation of component (ii). Emulsifier Preparation: A mixture of about 322.9 g hexadecenyl succinic anhydride 2 equivalents of C=0) and about 450 g of water was charged into about a 1 liter flask that was equipped with an overhead stirrer, a thermocouple N2 inlet and condenser. The mixture was heated to about 60° C. for about 4 hours, cooled to room temperature and sat overnight. The mixture was then rewarmed to about 60° for about 3 hours and then cooled to about 45° C. About 89 g of dimethylaminoethanol (1 mol) was added dropwise, resulting in an immediate increase in viscosity to the mixture. The mixture was then diluted with about 121 g of water and homogenized by stirring.

The emulsion preparation was per example 5. Emulsifier 1 was 2000 molecular weight polyisobutylene succinic anhydride/dimethylaminoethanol (1C—O:1N)EQ. The emulsifier prepared in this Example was used as emulsifier 2. The ratio of Solution 1 to 20z Solution 2 was 80:20 and was mixed in the Waring blender for 5 minutes at low speed.

These results demonstrate the emulsifier in water blended fuels produces an emulsion that does not separate after 7 days.

Example 5

The following example is provided to illustrate the emulsifier(v).

To a 5-liter flask equipped with heating mantle, overhead stirrer, pressure equalizing dropping funnel, nitrogen gas inlet, thermocouple and temperature control apparatus open to atmosphere is added poly-iso-butene succinic anhydride, about 3478 g, 2.0 Eq, Mn about 1600, contains about 30 wt % 100N diluent oil), poly[1-octadecene-alt-maleic anhydride] ("polyacidic polymer," about 312 g, 1 Eq, Mn about 15000) and diluent oil (about 139 g, 100N) The flask is then purged with nitrogen and raised to about 180° C. with stirring. A light flow of nitrogen is maintained during the course of reaction to aid removal of water. Triethylenetetramine ("amine," about 176 g, 1.4 Eq) is then added dropwise over 3 hours.

Once addition is complete, the reaction is stirred at about 180° C. for about 4 more hours. The reaction is then cooled and decanted into a pre-weighed container.

The reaction may also be carried out by first reacting the poly-iso-butene succinic anhydride with a polyamine to form a primary or secondary amine-containing succinimide which typically contains about 30 wt % hydrocarbyl diluent or other solvent. This product is referred to herein as the "fuel-soluble product." The emulsifier is the prepared by subsequent reaction of the fuel-soluble product with olefin/maleic anhydride copolymer. In this case, the product is similar to that outlined above.

Emulsifier 1 was the emulsifier prepared in this example and emulsifier 2 was the hexadecenyl succinic anhydride/dimethylaminoethanol (1:1) m. The ratio of Solution 1 to Solution 2 was 86.65 to 13:35 and was mixed in the Waring blender for about 6 minutes at high speed. The water-blended fuel gave no separation after 7 days. Emulsion Preparation General Procedure:

Solution 1:

2-ethyl hexyl nitrate, 0.36 wt %
emulsifier 1, 0.84 active wt %
emulsifier 2, 0.31 active wt %
diesel fuel (100–200 ml Solution 2:

Ammonium nitrate; 1.2 wt %
distilled water, 98.8 wt %

In a Waring blender, about 80 g of Solution 1 and about 20 g of Solution 2 were combined and blended at low speed for about 5 minutes. Alternately, about 86.65 g of Solution 1 and about 13.35 g of Solution 2 were combined in the Waring Blender at high speed for about 6 minutes.

Using either procedure, the emulsions were decanted into a beaker, cooled to room temperature, and then transferred to about 130 ml oil solubility tubes for storage.

The water in fuel emulsions prepared from the emulsifiers described in Examples 1–5 gave good stability with no appearance of water separation within one week at room temperature.

From the above description of examples and invention, those skilled in the art will perceive improvements, changes and modifications in the invention. Such improvements, changes and modifications are intended to be covered by the claims.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for making an aqueous hydrocarbon fuel composition comprising:

a) preparing at least one emulsifier to form a hydrocarbon fuel emulsifier mixture wherein the emulsifier comprises the reaction product of (A) a polyacidic polymer selected from the group consisting of $C_4$ to $C_{30}$ olefin/maleic anhydride copolymers, maleic anhydride/styrene copolymers, polymaleic anhydride, acrylic and methacrylic acid containing polymers, poly-alkyl acrylates, reaction products of maleic anhydride with polymers with multiple double bonds and combinations thereof, (B) at least one fuel soluble product made by reacting at least one hydrocarbyl-substituted carboxylic acid acylating agent, and (C) an ammonia or amine selected from the group consisting of a hydroxy amine, polymer amine or combinations thereof;

b) mixing the emulsifier with a liquid hydrocarbon fuel to form a hydrocarbon fuel emulsifier mixture; and c) mixing the hydrocarbon fuel emulsifier mixture with water or water and ammonium nitrate under emulsification conditions to form an aqueous hydrocarbon fuel composition, wherein the aqueous hydrocarbon fuel composition includes a discontinuous phase, the discontinuous phase being comprised of aqueous droplets having a mean diameter of 1.0 micron or less.

2. The process of claim 1 wherein the emulsifier comprises mixing the emulsifier with at least one of an ionic or non-ionic compound having a hydrophilic-lipophilic balance of about 1–40.

3. The process of claim 1 wherein the emulsifier comprises mixing the emulsifier with at least one of a water-soluble compound selected from the group consisting of amine salts, ammonium salts, azide compounds, nitrate esters, nitramine, nitro compounds, alkali metal salts, alkaline earth metal salts and combinations thereof.

4. The process of claim 2 wherein the emulsifier comprises mixing the emulsifier with at least one of a water-soluble compound selected from the group consisting of amine salts, ammonium salts, azide compounds, nitrate esters, nitramine, nitro compounds, alkali metal salts, alkaline earth metal salts and combinations thereof.

5. The process of claim 1 wherein the temperature in the range of 60° C. to about 250° C., at atmospheric temperature until a crosslinked polymer dispersant is formed.

6. The process of claim 1 wherein the $C_4$ to $C_{30}$ olefin/maleic anhydride copolymer has the olefin selected from the group consisting of 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-eicosene, 1-docosene, 1-triacontene, and the like, the alpha olefin fractions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and combinations thereof.

7. The process of claim 1 wherein the hydrocarbon fuel emulsifier mixture is made by a method selected from the group consisting of condensation, condensation/polymerization process, and combinations thereof.

8. A process of claim 1 wherein the emulsifier is prepared by reacting A) a polyacidic polymer with a fuel soluble product comprising the reaction product of B) at least one fuel soluble product made by reacting at least one hydrocarbyl-substituted carboxylic acid acylating agent and C) a hydroxy amine, a polyamine, or combinations thereof.

9. An aqueous hydrocarbon fuel composition comprising:

a) a continuous phase of hydrocarbon fuel;

b) a discontinuous aqueous phase being comprised of aqueous droplets having a mean diameter of 1.0 micron or less; and c) an emulsifying amount of an emulsifier composition comprising the reaction product of (A) a polyacidic polymer selected from the group consisting of $C_4$ to $C_{30}$ olefin/maleic anhydride copolymers, maleic anhydride/styrene copolymers, polymaleic anhydride, acrylic and methacrylic acid containing polymers, poly-alkyl acrylates, reaction products of maleic anhydride with polymers with multiple double bonds and combinations thereof, (B) at least one fuel soluble product made by reacting at least one hydrocarbyl-substituted carboxylic acid acylating agent and C) a hydroxy amine, a polyamine, or combinations thereof.

10. The composition of claim 9 wherein the emulsifier comprises a mixture of 1) the reaction product of A) a polyacidic polymer, B) at least one fuel soluble product made by reacting at least one hydrocarbyl-substituted carboxylic acid acylating agent and C) a hydroxy amine and/or a polyamine mixed with 2) at least one of an ionic or non-ionic compound having a hydrophilic-lipophilic balance of about 1–40.

11. The composition of claim 9 wherein the emulsifier comprises a mixture of the 1) reaction product of A) a polyacidic polymer, B) at least one fuel-soluble product made by reacting at least one hydrocarbyl-substituted carboxylic acid acylating agent and C) a hydroxy amine or a polyamine with 2) a water-soluble compound selected from the group consisting of amine salts, ammonium salts, azide compounds, nitrate esters, nitramine, nitro compounds, alkali metal salts, alkaline earth metal salts, and combinations thereof.

12. The composition of claim 9 wherein the emulsifier comprises a mixture of 1) the reaction product of A) a polyacidic polymer, B) at least one fuel soluble product made by reacting at least one hydrocarbyl-substituted carboxylic acid acylating agent and C) a hydroxy amine and/or a polyamine mixed with 2) at least one of an ionic or non-ionic compound having a hydrophilic-lipophilic balance of about 1–40, and with 3) a water-soluble compound selected from the group consisting of amine salts, ammonium salts, azide compounds, nitrate esters, nitramine, nitro compounds, alkali metal salts, alkaline earth metal salts, and combinations thereof.

13. The composition of claim 9 wherein the $C_4$ to $C_{30}$ olefin/maleic anhydride copolymer has the olefin selected from the group consisting of 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-eicosene, 1-docosene, 1-triacontene, and the like, the alpha olefin fractions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and combinations thereof.

14. The composition of claim 9 wherein said polyacidic polymer is selected from the group consisting of $C_8$ to $C_{20}$ olefin/maleic anhydride copolymers.

15. The composition of claim 9 wherein said polyacidic polymer is selected from the group consisting of 1-octadecene/maleic anhydride copolymer.

16. The composition of claim 9 wherein the polyacidic polymer is a copolymer of an olefin and a compound having the structure

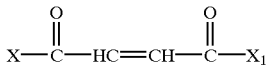

wherein X and $X_1$ are the same or different provided that at least one of X and $X_1$ is such that the copolymer can function as a carboxylic acylating agent.

17. The composition of claim 9 wherein the polyacidic polymer is a copolymer of octadecene-1 and maleic anhydlide, the copolymer having a number average molecular weight from greater than 6300 to less than 12000.

18. The composition of claim 9 wherein the emulsifier comprises about 25% to about 95% of the fuel soluble product and about 0.1% to about 50% of polyacidic polymer.

19. The composition of claim 9 wherein the emulsifier comprises about 50% to about 92% of the fuel soluble product and about 1% to about 20% of polyacidic polymer.

20. The composition of claim 9 wherein the emulsifier comprises about 70% to about 90% of the fuel soluble product and about 5% to about 10% of polyacidic polymer.

* * * * *

UNITED STATES PATENT AND TRADEMARK OFFICE

CERTIFICATE OF CORRECTION

PATENT NO. : 6,419,714 B2 
DATED : July 16, 2002
INVENTOR(S) : Claire L. Thompson and Douglas M. Barr It is certified that error appears in the above-identified patent and that said Letters Patent is hereby corrected as shown below:

Title page,
Item [54], Title, change "ACQUEOUS" to -- AQUEOUS --.

Signed and Sealed this

Twenty-fifth Day of February, 2003

JAMES E. ROGAN
*Director of the United States Patent and Trademark Office*